United States Patent [19]

Stratton

[11] Patent Number: 4,593,513

[45] Date of Patent: Jun. 10, 1986

[54] BUILDING BLOCK OR PANEL

[76] Inventor: Frank Stratton, 144 Treasure Road, Queens Park, Western Australia, Australia

[21] Appl. No.: 513,963

[22] PCT Filed: Nov. 11, 1982

[86] PCT No.: PCT/AU82/00184

§ 371 Date: Jul. 6, 1983

§ 102(e) Date: Jul. 6, 1983

[87] PCT Pub. No.: WO83/01803

PCT Pub. Date: May 26, 1983

[30] Foreign Application Priority Data

Nov. 12, 1981 [AU] Australia ..... PE1533

[51] Int. Cl.[4] ..... E04C 1/30

[52] U.S. Cl. ..... 52/578; 52/598; 52/604; 52/609; 404/41

[58] Field of Search ..... 52/429, 561, 563, 564, 52/574, 578, 598, 603, 604, 608, 609, 610, 611; 404/34, 35, 41, 42

[56] References Cited

U.S. PATENT DOCUMENTS

| | | | |
|---|---|---|---|
| 1,430,392 | 9/1922 | Lukens | 404/41 |
| 1,969,729 | 8/1934 | Damianik | 404/41 |
| 2,189,218 | 2/1940 | Neumeister | 52/587 |
| 2,882,714 | 4/1959 | Gagle et al. | 52/604 |
| 3,557,501 | 1/1971 | Kotozsuary | 52/574 |
| 3,672,110 | 6/1927 | Nordstrom | 52/574 |
| 3,996,715 | 12/1976 | Dowse | 52/609 |
| 4,429,506 | 2/1984 | Henderson | 52/589 |

FOREIGN PATENT DOCUMENTS

| | | | |
|---|---|---|---|
| 274695 | 1/1966 | Australia . | |
| 36719 | 10/1969 | Australia . | |
| 489803 | 1/1953 | Canada | 52/604 |
| 90076 | 10/1967 | France | 52/608 |
| 2509344 | 1/1983 | France | 52/561 |
| 254416 | 7/1926 | United Kingdom | 52/592 |

*Primary Examiner*—John E. Murtagh
*Assistant Examiner*—Andrew Joseph Rudy
*Attorney, Agent, or Firm*—Harness, Dickey & Pierce

[57] ABSTRACT

A building block or panel having the shape of a right parallelepiped having two opposed major faces (11), the remaining faces being edge faces which are formed to interlockingly engage with the edge faces of similar building blocks wherein two pairs of adjacent edge faces at opposed sides of the block are each formed with an elogate recess (13) extending from the respective corner of said adjacent edge faces to an intermediate location on each edge face, each edge face being formed with an elongate projection (15) which is able to be received in the recess (13) of a corresponding block; the one end (17) of each projection (15) adjacent the respective recess (13) being contoured to define at least a portion inclined at an angle of less than 90° between the face and the base of the respective recess wherein the other end of each projection (15) has a face of a complementary configuration.

22 Claims, 9 Drawing Figures

BUILDING BLOCK OR PANEL

This invention relates to an improved building block or panel.

There have been numerous attempts to provide building blocks or panels with interlocking edges which can be assembled without the need for bonding agents to form walls and similar structures. One such interlocking block is described in my Australian Pat. No. 274695. Whilst this interlocking block proved to be satisfactory in use, it has now been found that by providing diagonally opposite corners of a rectangular or square block or panel with recesses which extend around the corner and by providing the other pair of diagonally opposite corners with projections, the blocks or panels can be locked together in a manner which gives considerable strength in a wall structure to provide a wall structure which can resist forces applied transversely to the wall. In addition, the block of Pat. No. 274695 required a high degree of precision which was unacceptable to conventional manufacturing practice.

In one form the invention resides in a building block or panel having the shape of a right parallelepiped having two opposed major faces, the remaining faces being edge faces which are formed to interlockingly engage with the edge faces of similar building blocks wherein two pairs of adjacent edge faces at opposed sides of the block are each formed with an elongate recess extending from and through the respective corner of said adjacent edge faces to an intermediate location on each edge face, each edge face also being formed with an elongate projection which is able to be received in the recess of a corresponding block; the one end of each projection adjacent the respective recess being contoured to define at least a portion inclined at an angle of less than 90° between the face and the base of the respective recess wherein the other end of each projection has a face of a complementary configuration. dr The invention will be better understood by reference to the following description of one specific embodiment of the invention shown in the accompanying drawings wherein:

Figure 1:
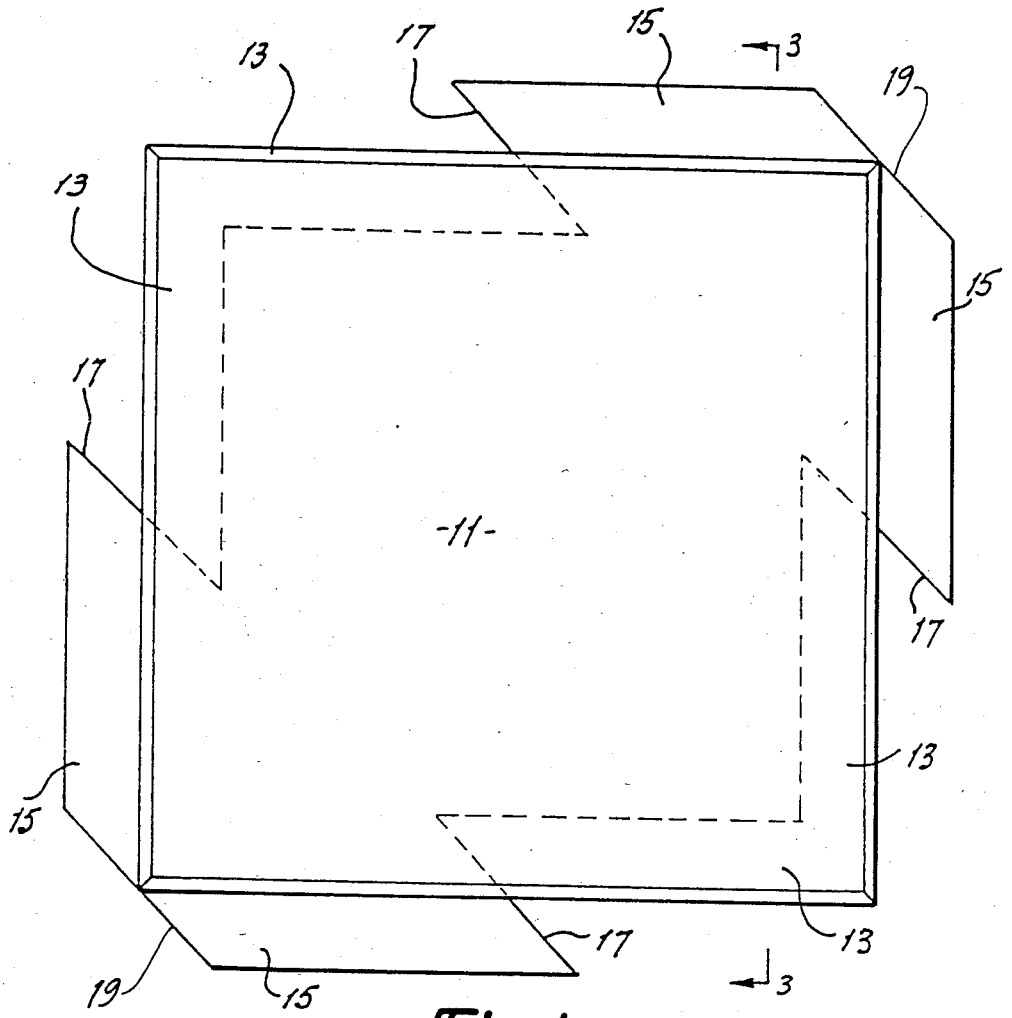
FIG. 1 is a side elevation of one block.
Figure 2:
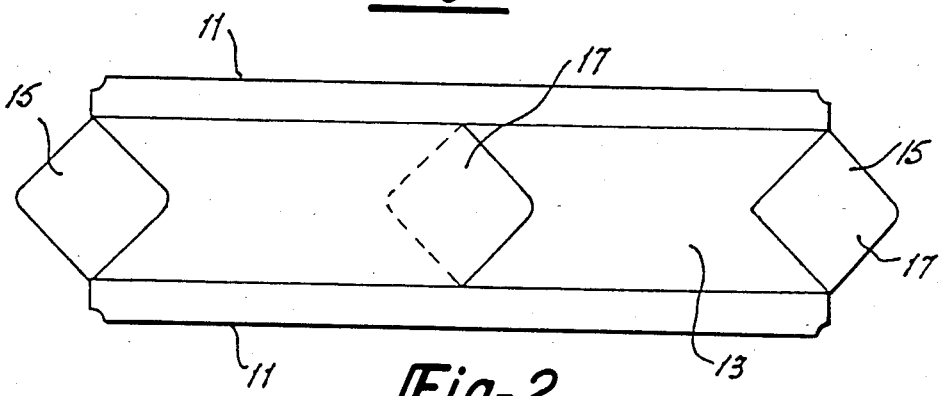
FIG. 2 is an inverted plan view.
Figure 3:
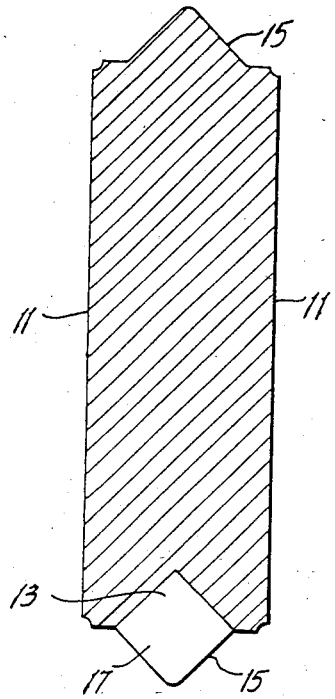
FIG. 3 is a section of line 3—3 of FIG. 1.
Figure 4:
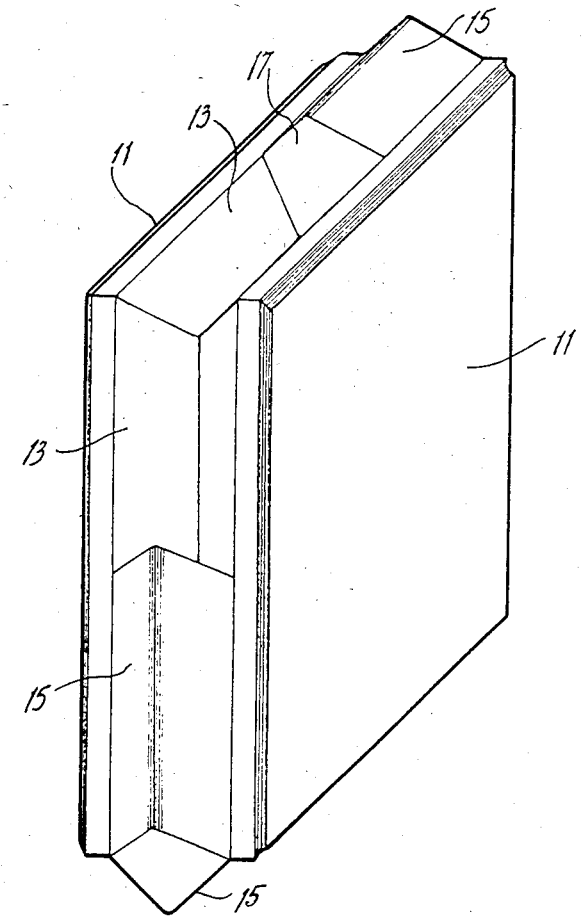
FIG. 4 is a perspective view.

The embodiment as shown in the drawings is directed to a building block having the shape of a right parallelepiped having two opposed major faces 11 which are substantially square, separated by four edge faces which are rectangular. Each edge face is formed with a recess 13 of a V-shaped configuration extending approximately half the length of each face and wherein the recesses of a pair of adjacent edge faces open into each other at the corner. At the diagonally opposite corner the recesses of the respective edge faces also open into each other. The remaining portion of each edge face is formed with a projection 5 having a cross-sectional configuration which is complementary to the recess 13 such that it would be fully received in the recess of a corresponding block. At the junction of the recess 13 with the projection at each edge face the end face 17 so formed, is substantially planar, is transversely positioned across the edge face and forms an acute angle of approximately 45° or greater with the base of the recess to overlie the recess. The other end 19 of each pair of projections 15 which are adjacent the corners of the block are planar and are formed to define an angle which is complementary to the angle at the junction end 17 of the projection (ie; 45° or less). The adjacent other ends 19 of the projections 15 of a pair of adjacent faces are substantially co-planar.

On location of the blocks in position the projections on one block are received in the recesses of the adjacent blocks and due to the complementary configurations of the opposite ends of the projections, the blocks when in position lock into each other and thus the blocks of each course will be locked into engagement with each other and each course of blocks will be locked together.

Figure 5A:
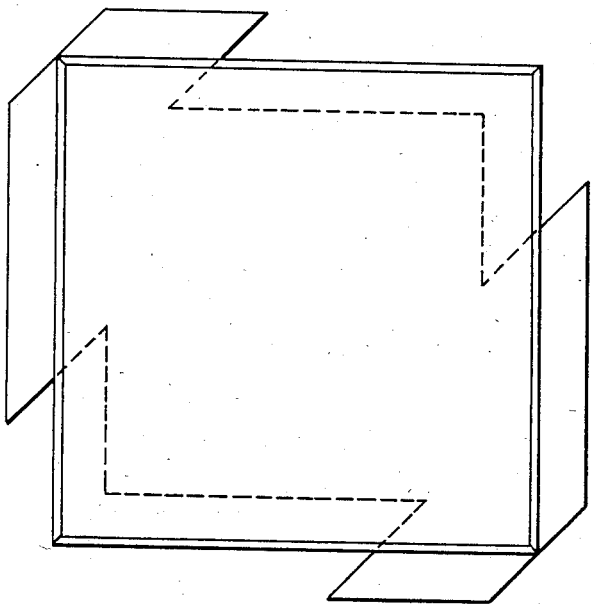
FIGS. 5A and 5B illustrate two further alternatives of blocks according to the invention.
Figure 5B:
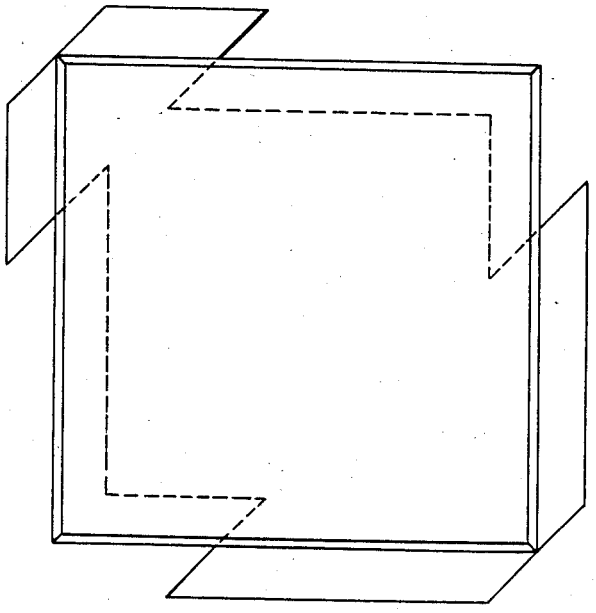
Figure 6A:
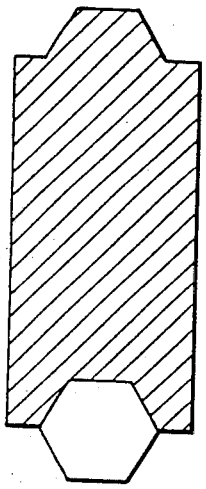
FIG. 6 illustrate alternative cross-sectional configurations of the groove and elongate projection of blocks according to the invention.
Figure 6B:
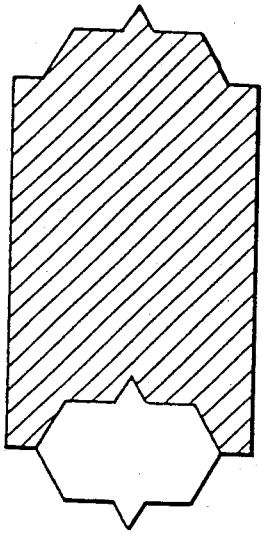
Figure 6C:
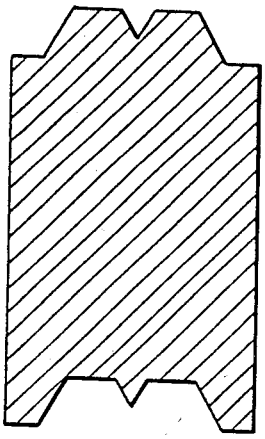
Figure 6D:
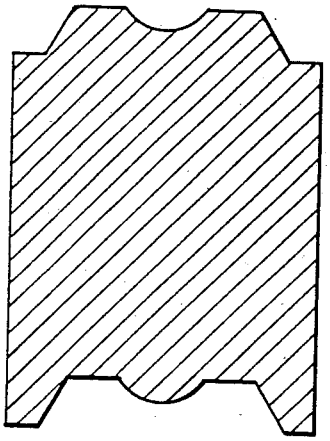
Figure 6E:
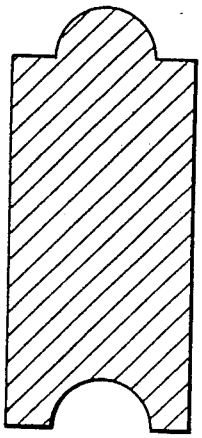
Figure 6F:
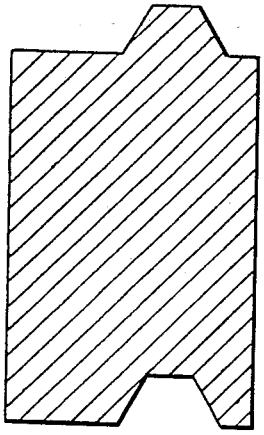
Figure 6G:
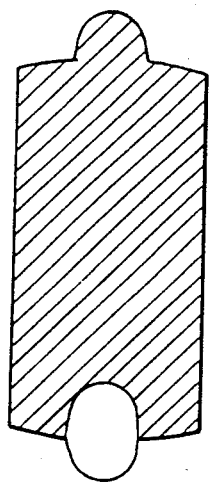
Figure 7A:
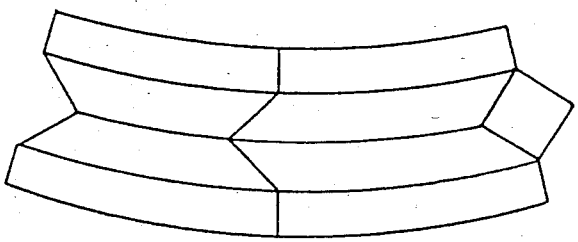
FIGS. 7A and 7B illustrate two alternative profiles of blocks according to the invention.
Figure 7B:
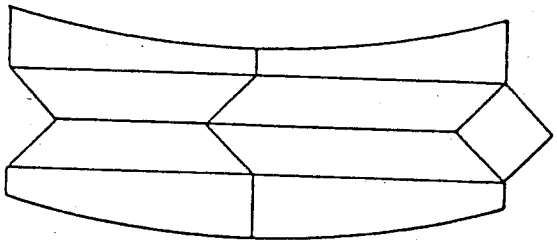

As shown at FIGS. 5A and 5B, the recess and elongate projections of the block need not be of equal length. In addition, as shown at FIGS. 6A to 6B, the cross-sectional profile of the elongate projections and recesses may be of any desired configuration. In particular as shown at FIG. 6F, the recess and elongate projection need not be centrally located on the edge faces of the block and as shown at FIG. 6G, the portions of the edge faces to either side of the recess and elongate projection may be contoured. The edge face configuration of 6G facilitates the fabrication of curved walls and if desired may be restricted to one or a pair of opposed edge faces of a block. The major faces of the block may be contoured and in the cases shown at FIGS. 7A and 7B, where the major faces are curved about a transverse axis, the recesses and elongate projections of the respective blocks of the respective edge faces may or may not adapt a corresponding curvature.

It should be appreciated that the scope of the present invention need not be limited to the particular scope of the embodiment described above and in particular to the particular cross-sectional configuration of the recesses or projections or of the interlocking end faces referred to in the specification. In addition, the invention includes within its scope panels.

The claims defining the invention are as follows:

I claim:

1. A building block or panel having the shape of a right parallelepiped having edge faces and two opposed major faces, said edge faces being formed to interlockingly engage with edge faces of similar building blocks wherein two pairs of adjacent edge faces at opposed sides of the block are each formed with an elongated recess extending from and through a respective corner of said adjacent edge faces to an intermediate location on each edge face, each edge face also being formed with an elongated projection adjacent to said recess and extending from said intermediate location to a successive corner on each edge face, said projection being configured to be received in a recess of a corresponding block;

each projection having an end, adjacent to its respective recess being contoured to define at least a portion inclined at an angle of less than 90° between the face and base of the respective recess wherein the other end of each projection has a face of complimentary configuration.

2. A building block or panel as claimed at claim 1 wherein said projection on each edge face extends from the intermediate location to the other corner of said edge face.

3. A building block or panel as claimed at claim 2 wherein the one end of each projection is substantially planar and extends transversely across the edge face and defines an acute angle of from, 45° to less than 90°, to the edge face.

4. A building block or panel as claimed at claim 3 wherein said one end is disposed at an angle of approximately 45° to the base of the recess.

5. A building block or panel as claimed at claim 3 wherein the recess is of a V-shaped cross-sectional configuration and said projection is of a complementary cross-sectional configuration.

6. A building block or panel as claimed at claim 3 wherein said major faces are substantially square.

7. A building block or panel as claimed at claim 3 wherein said major faces are substantially co-planar.

8. A building block or panel as claimed at claim 3 wherein at least one of said major faces is curved above at least one axis and said recesses and elongate projections are substantially co-planar.

9. A building block or panel as claimed at claim 3 wherein at least one of said major faces is curved about at least two axes and the axes of said recesses and elongate projections are parallel with the at least one major face.

10. A building block or panel as claimed at claim 1 wherein said intermediate location is located substantially centrally along said edge face.

11. A building block or panel as claimed at claim 1 wherein a pair of elongated projections extend for a distance along their respective edge faces for a distance beyond the middle of said edge face and the other pair of elongate projections have a length complementary to the length of the first pair of elongate projections.

12. A building block or panel as claimed at claim 11 wherein said elongate projections of said first pair are located on adjacent edge faces.

13. A building block or panel as claimed at claim 11 wherein said first pair of elongate projections are on opposite faces.

14. A building block or panel as claimed in claim 2 wherein said projection extends from said intermediate location on each said edge face to an opposite corner on each said edge face.

15. A building block or panel as claimed at claim 1 wherein the one end of each projection is substantially planar and extends transversely across the edge face and defines an acute angle of 45° or more to the edge face.

16. A building block or panel as claimed at claim 1 wherein the recess is of a V-shaped cross-sectional configuration and said projection is of a complementary cross-sectional configuration.

17. A building block or panel as claimed at claim 2 wheren the recess is of a V-shaped cross-sectional configuration and said projection is of a complementary cross-sectional configuration.

18. A building block or panel as claimed at claim 1 wherein said major faces are substantially square.

19. A building block or panel as claimed at claim 2 wherein said major faces are substantially square.

20. A building block or panel as claimed at claim 1 wherein said major faces are substantially co-planar.

21. A building block or panel as claimed at claim 2 wherein said major faces are substantially co-planar.

22. A building block or panel as in claim 1 wherein the block is symmetric about a diagonal from said respective corner to an opposite non-successive corner.

* * * * *